US007143599B2

(12) United States Patent
Wo

(10) Patent No.: US 7,143,599 B2
(45) Date of Patent: Dec. 5, 2006

(54) REFRIGERATOR HAVING DISPLAY

(75) Inventor: Ki-Cheol Wo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 337 days.

(21) Appl. No.: 10/793,756

(22) Filed: Mar. 8, 2004

(65) Prior Publication Data

US 2004/0177624 A1 Sep. 16, 2004

(30) Foreign Application Priority Data

Mar. 10, 2003 (KR) ..... 10-2003-0014895
Dec. 22, 2003 (KR) ..... 10-2003-0094937

(51) Int. Cl.
*F25D 23/12* (2006.01)

(52) U.S. Cl. ..... 62/259.2; 165/80.3; 62/331

(58) Field of Classification Search ..... 62/331, 62/259.2, 3.1–3.6; 348/61, 739, 836; 165/80.3; 361/690–697
See application file for complete search history.

(56) References Cited

U.S. PATENT DOCUMENTS 3,823,567 A * 7/1974 Corini ..... 62/3.6
4,571,740 A * 2/1986 Kirby et al. ..... 455/344
5,315,830 A * 5/1994 Doke et al. ..... 62/3.2
5,605,047 A * 2/1997 Park et al. ..... 62/3.6
6,164,369 A * 12/2000 Stoller ..... 165/104.33
6,442,952 B1 * 9/2002 Roh et al. ..... 62/127
6,483,695 B1 * 11/2002 Hartstein ..... 361/680
6,809,295 B1 * 10/2004 Vargas ..... 219/393
6,853,399 B1 * 2/2005 Gilman et al. ..... 348/61

FOREIGN PATENT DOCUMENTS

JP 406350941 A * 12/1994

* cited by examiner

*Primary Examiner*—William E. Tapolcai
(74) *Attorney, Agent, or Firm*—Fleshner & Kim, LLP

(57) ABSTRACT

A refrigerator includes a refrigerator body having a freezing chamber, a refrigerating chamber and the like, a refrigerator door mounted at the refrigerator door; a display mounted at the refrigerator body or at one side of the door; and a radiation unit for cooling heat generated from the display. Accordingly, the refrigerator has both food item function and image medium function, so that space utilization of a room or a kitchen is improved, users' convenience is heightened, and heat generated from the display can be effectively cooled for a smooth operation.

33 Claims, 5 Drawing Sheets

REFRIGERATOR HAVING DISPLAY

BACKGROUND OF THE INVENTION

1. Field of the Invention

The present invention relates to a display-provided refrigerator and, more particularly, to a refrigerator having a display including a TV function suitable for improving space utilization of a room or a kitchen and effectively discharging heat generated from the display.

2. Description of the Background Art

In general, a refrigerator keeps food items such as meats, fishes and vegetables fresh. The refrigerator includes a refrigerator body having a freezing chamber, a refrigerating chamber, a vegetable chamber, or the like, and a door mounted at one side of the refrigerator body and opening and closing the freezing chamber and the refrigerating chamber.

The refrigerator body includes a refrigerating cycle system having a compressor, a condenser, a capillary tube, an evaporator, and the like, a blowing fan for enforcing cooling air to flow, and a circulation passage for guiding cooling air formed in the evaporator to flow into the evaporator after passing through the freezing chamber and the refrigerating chamber.

The refrigerator operates as follows.

When a temperature in the freezing chamber or in the refrigerating chamber is not lower than a pre-set temperature, the refrigerating cycle system operates. Accordingly, cooling air is formed in the evaporator and then flows according to operation of the blowing fan. As cooling air formed in the evaporator flows through the circulation passage, the freezing chamber, the refrigerating chamber and the vegetable room provided in the refrigerating chamber are maintained at the pre-set temperature.

The refrigerator is classified into various types depending on a cooling air circulating method, positions of the freezing chamber and the refrigerating chamber and the construction of the evaporator.

The refrigerator is being enlarged in size to meet user's desires and various functions are added to improve user's convenience. For example, a dispenser is provided at the refrigerator door, so water or ices can be used from outside without opening the door. In addition, the refrigerator door has a home bar, so drinking water, or the like, kept in the refrigerating chamber can be drawn out without opening the refrigerator door.

The refrigerator is generally positioned in a living room or in a kitchen in houses. Thus, as the refrigerator is enlarged, it takes more space in the living room or in the kitchen, deteriorating utilization of the room or the kitchen. In addition, since the large refrigerator is located in the kitchen or in the living room, it, in a way, serves as decorations to influence an atmosphere of the room or the kitchen.

SUMMARY OF THE INVENTION

Therefore, one object of the present invention is to provide a refrigerator having a display including a TV function capable of improving space utilization in a room or a kitchen and users' convenience of using electric appliances.

Another object of the present invention is to provide a refrigerator having a display capable of effectively releasing heat generated from the display.

To achieve these and other advantages and in accordance with the purpose of the present invention, as embodied and broadly described herein, there is provided a refrigerator including: a refrigerator body having a freezing chamber, a refrigerating chamber and the like, a refrigerator door mounted at the refrigerator door; a display mounted at the refrigerator body or at one side of the door; and a radiation unit for cooling heat generated from the display.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
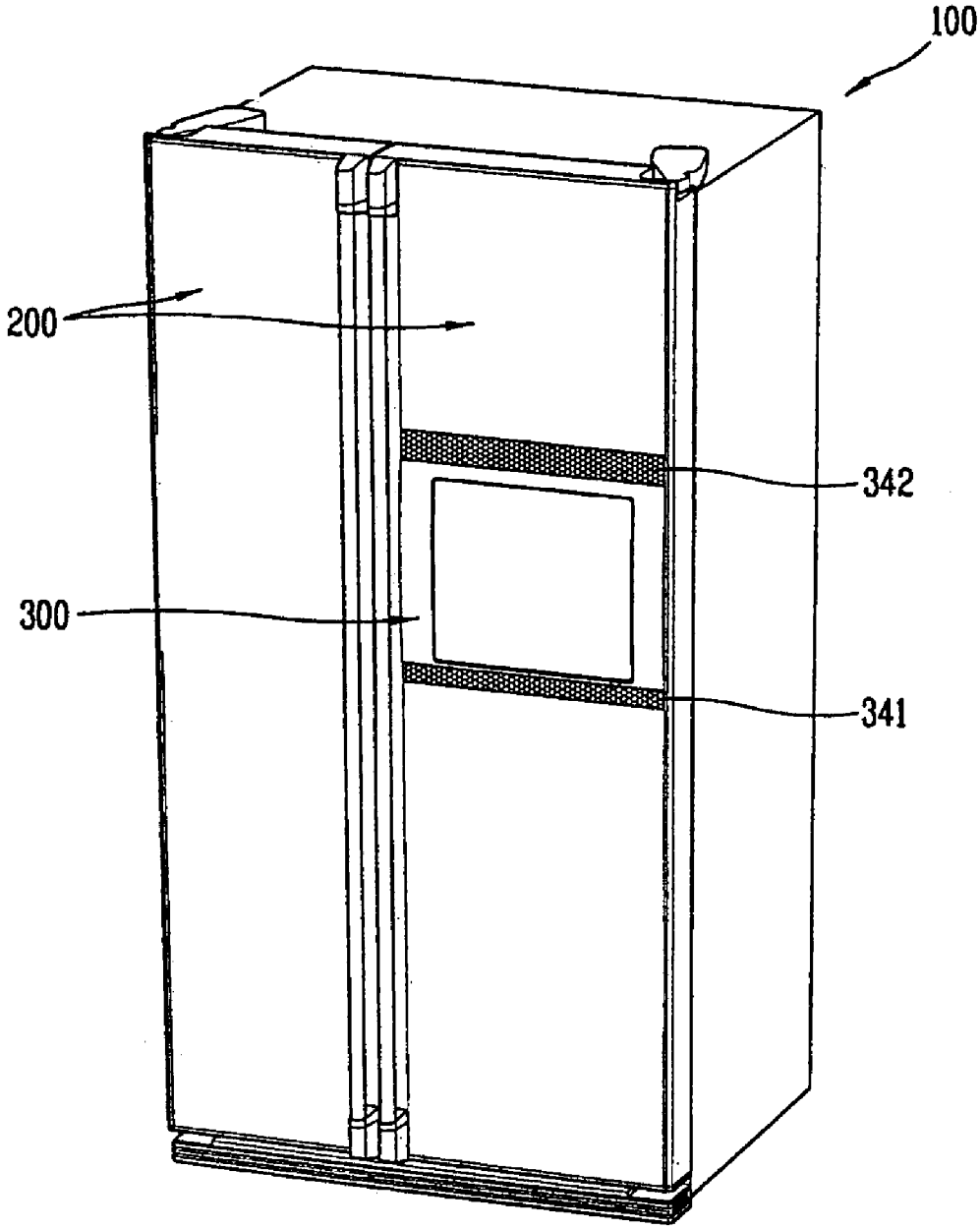
FIG. 1 is a perspective view showing one example of a refrigerator having a display in accordance with the present invention.
Figure 2:
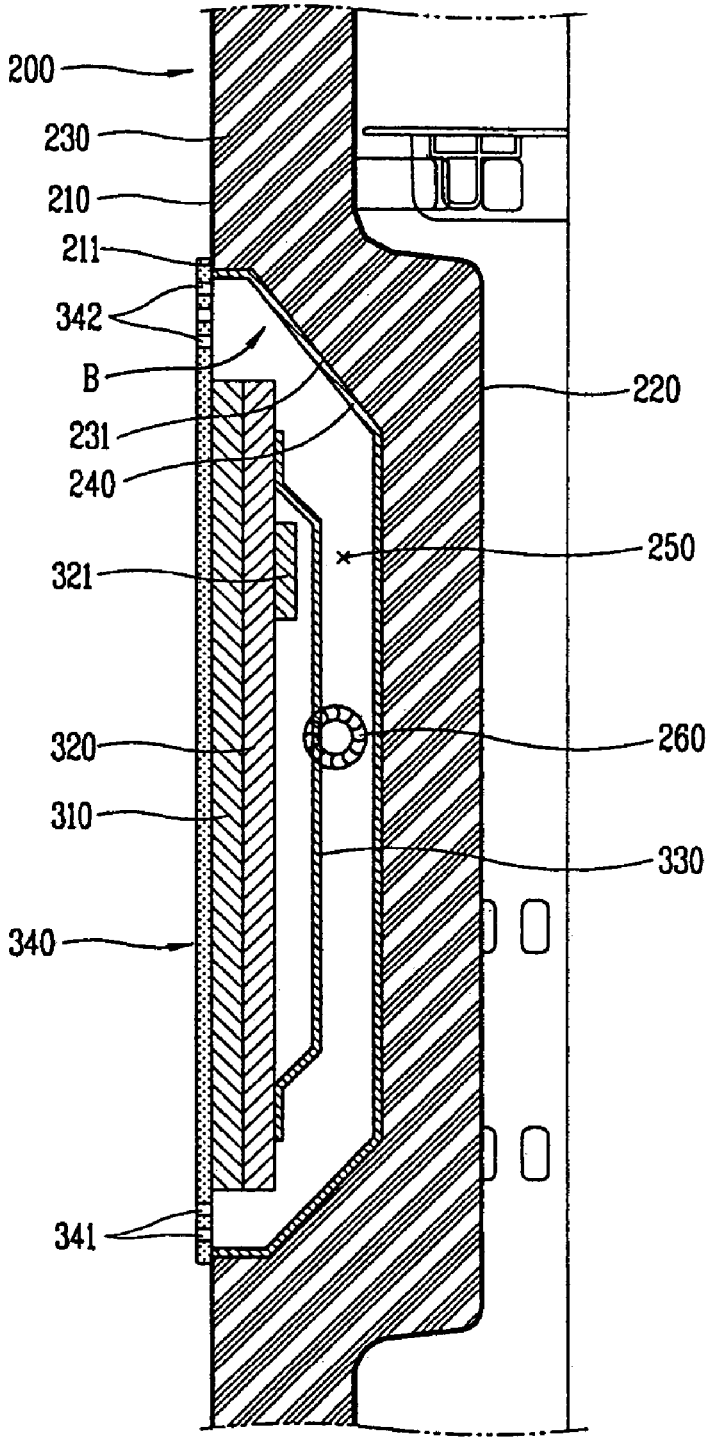
FIG. 2 is a partial sectional view of the refrigerator having the display.

FIG. 1 is a perspective view showing one example of a refrigerator having a display in accordance with the present invention, and FIG. 2 is a partial sectional view of the refrigerator having the display.

As shown in FIGS. 1 and 2, the refrigerator having a display includes a refrigerator body 100, a refrigerator door 200 mounted at the refrigerating body 100, a display 300 mounted at one side of the door 200, and a radiation unit for cooling heat generated from the display 300.

The refrigerator body 100 includes a freezing chamber (not shown) for keeping a food item frozen therein, a refrigerating chamber (not shown) for keeping a food item refrigerated, and a vegetable room (not shown) for keeping vegetables or fruits.

The freezing chamber door 200 is mounted at one side of the refrigerator body to open and close the freezing chamber, and the refrigerating chamber door 200 is mounted at the other side of the refrigerator body 100 to open and close the refrigerating chamber.

A mounting part (B) having a prescribed area and depth is provided at one side of the front surface of the refrigerating chamber door 200, and the display 300 is mounted at the mounting part (B). The display 300 includes an LCD panel 310, a control circuit board 320 and a panel frame 340 supporting the LCD panel 310.

As for the display 300, the LCD panel 310 and the control circuit board 320 are positioned in the mounting part (B). The LCD panel 310 is fixed at the side of the refrigerator door 200.

The mounting part B of the refrigerator door includes a hole 211 formed with a prescribed size on an outer plate 210 constituting the refrigerator door 200, a recess 231 formed with a prescribed area and depth in an insulation member 230 positioned between the outer plate 210 of the door and an inner plate 220, and an inner wall casing 240 formed corresponding to an inner surface of the recess 231 of the insulation member 231, having a certain thickness, and insertedly coupled to the recess 231 of the insulation member.

The radiation unit includes an air circulation passage for guiding external air introduced into the mounting part (B), in which the display 300 is inserted, to flow externally after passing through the inner wall of the mounting part (B), that is, the inner wall casing 240, and a rear surface of the display 300.

The air circulation passage includes an inlet 341 and an outlet 342 formed penetratingly at the panel frame 341 covering the mounting part (B) and an inner passage 250, a space between a real wall of the display 300 and an inner wall of the mounting part (B), communicating with the inlet 341 and the outlet 342 of the panel frame.

The inlet 341 and the outlet 342 are formed at upper and lower parts of the panel frame 340. The inlet 341 and the outlet 342 can be formed at left and right parts of the panel frame 340.

Preferably, the inlet 341 and the outlet 341 include a plurality of small holes.

In order to effectively releasing heat generated from the display 300, a heat releasing fan 260 for forcibly circulating air can be provided in the air circulation passage.

The heat releasing fan 260 is preferably installed adjacent to an element from which much heat is generated, among parts constituting the display 300. An element that may generate the most heat in the display 300 is an inverter 321, and the heat releasing fan 260 is preferably installed at the side of the inverter 321.

Reference numeral 330 is an electromagnetic wave blocking plate.

The refrigerator having the display 300 operates as follows.

First, generally, like in a related art refrigerator, food items are kept in the freezing chamber or in the refrigerating chamber as necessary, and vegetables or fruits are kept in the vegetable chamber, and if a preserved food item is desired to be used, a user opens the refrigerator door 200 and takes out the preserved food item.

If the user desires to enjoy a TV program, he/she may turn on the display 300 mounted on the refrigerator door 200 to view a desired TV program.

When the display 300 operates, heat is generated mainly from the control circuit board 320, and specifically, from the inverter 321 constituting the control circuit board 320.

Figure 3:
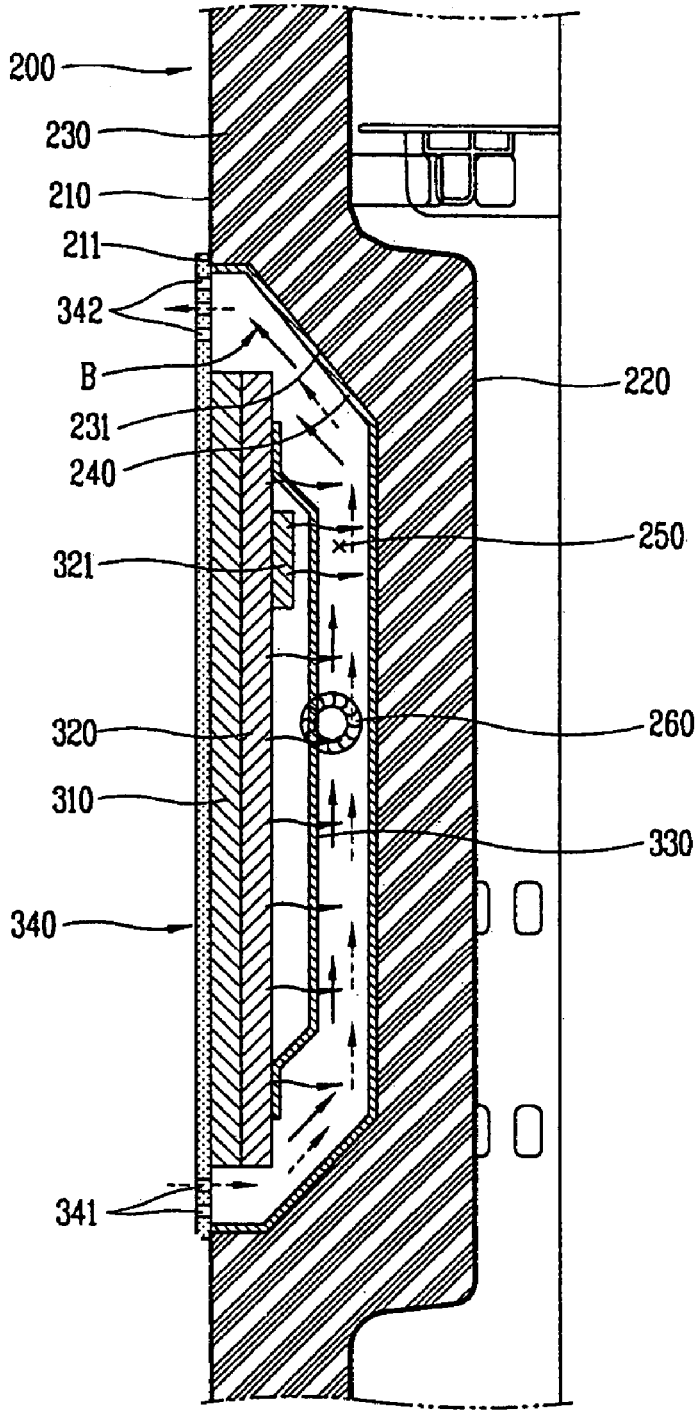
FIG. 3 is a partial sectional showing an operation state of the refrigerator having the display.

As shown in FIG. 3, heat generated from the display 300 is discharged together with external air that is introduced and discharged through the air circulation passage. Namely, external air is introduced into the mounting part (B) through the inlet 341 formed at the panel frame 340, flows through the inner passage 250, the space between the rear surface of the display 300, that is, the rear surface of the control circuit board 320, and the inner wall of the mounting part (B), and flows out through the outlet 342 formed at the panel frame 340.

In this process, as heat generated from the display 300 is externally discharged together with air, cooling the display 300.

In the case that the heat releasing fan 260 is mounted in the air circulation passage, since external air can forcibly flow through the air circulation passage thanks to an operation of the heat releasing fan 260, heat releasing effect can be enhanced.

The radiation unit constituting the refrigerator having the display can be implemented in various forms, one of which will now be described.

Figure 4:
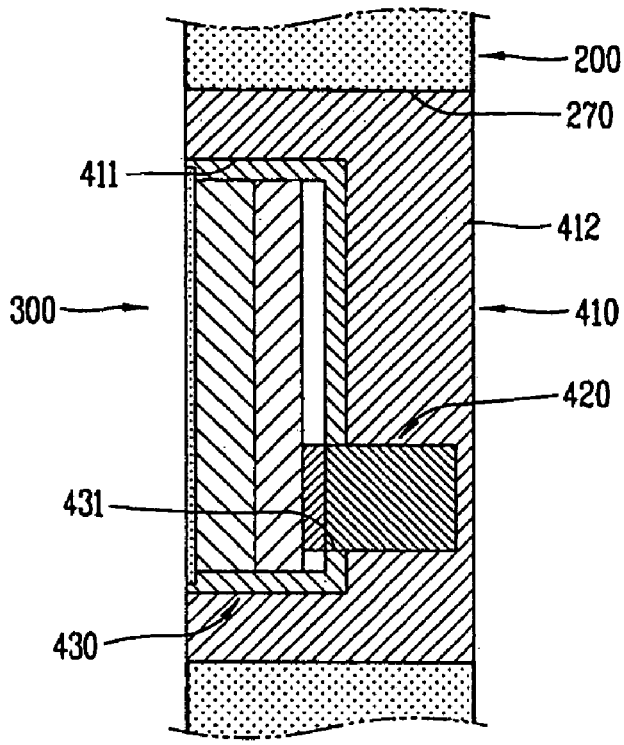
FIG. 4 is a sectional view showing a radiation unit of a refrigerator having a display in accordance with the present invention.

FIG. 4 is a sectional view showing a radiation unit of a refrigerator having a display in accordance with the present invention.

As shown in FIG. 4, another radiation unit includes a mounting hole 270 penetratingly formed with a certain area at one side of the refrigerator door 200, an insulation casing 410 insertedly fixed in the mounting hole of the refrigerator door and having a mounting recess 411 in which the display 300 is mounted, and a heat transfer member 420 coupled to the insulation casing 410 and transferring heat generated from the display 300 to a cold space at an inner side of the door.

The mounting hole 270 of the refrigerator door is formed in a square form at one side of the front surface of the refrigerator door 200. The insulation casing 410 has a hexahedral outer shape so as to be inserted into the square mounting hole, and the mounting recess 411 is formed at one surface thereof.

The display 300 is preferably inserted in a display casing 430 having a certain shape and mounted in the mounting recess 411 of the insulation casing.

A hole 431 is preferably formed at the display casing 430 so that the inverter 321 constituting the control circuit board 320 of the display can be exposed therethrough.

The heat transfer member 420 is formed with a prescribed length. The heat transfer member 420 is coupled to a rear wall 412 of the insulation casing, and one side of the heat transfer member 420 is in contact with a heat generating element of the display 300. Among parts of the display 300, the inverter 321 generates the greatest amount of heat, so the heat transfer member 420 is preferably in contact with the inverter 321.

In order to effectively transfer heat generated from the display 300 to the heat transfer member 420, a heat transfer thin plate (not shown) having a certain area can be in contact with the rear surface of the display 300, that is, the rear surface of the control circuit board 320, and the heat transfer member 420 can be in contact with the heat transfer thin plate.

The heat transfer member 420 is coupled such that one end thereof is positioned in the rear wall 412 of the insulation casing. The rear wall 412 of the insulation casing is positioned at the side of the refrigerating chamber or the freezing chamber of the refrigerator body 100.

Figure 5:
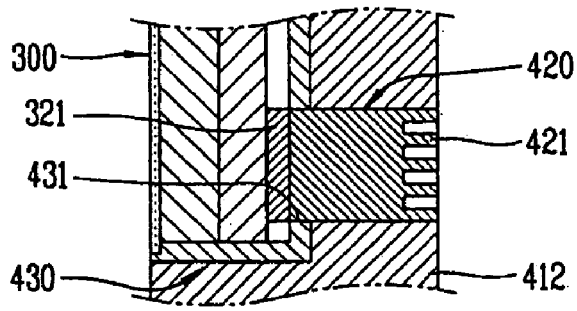
FIG. 5 is a partial sectional view of the refrigerator having the display.

In order to effectively transfer heat to the refrigerating chamber or to the freezing chamber, the inner side of the refrigerator door 200, as shown in FIG. 5, one side of the heat transfer member 420 is penetratingly coupled to the rear wall 412 of the insulation casing so as to be exposed to the refrigerating chamber or to the freezing chamber.

Preferably, a plurality of radiation fins 421 are provided at the end of the heat transfer member 420 exposed to the refrigerating chamber or to the freezing chamber.

The heat transfer member 420 is made of a material containing aluminum having an excellent heat transfer performance.

The heat transfer thin plate is made of a material containing at least one of aluminum or copper.

The radiation unit operates as follows.

First, when the user operates the display 300 mounted at the door 200 of the refrigerator, heat is generated from the display 300. While the display 300 is operating, heat is generated from the control circuit board 320, and specifically, mostly from the inverter 321 of the control circuit board 320.

Figure 6:
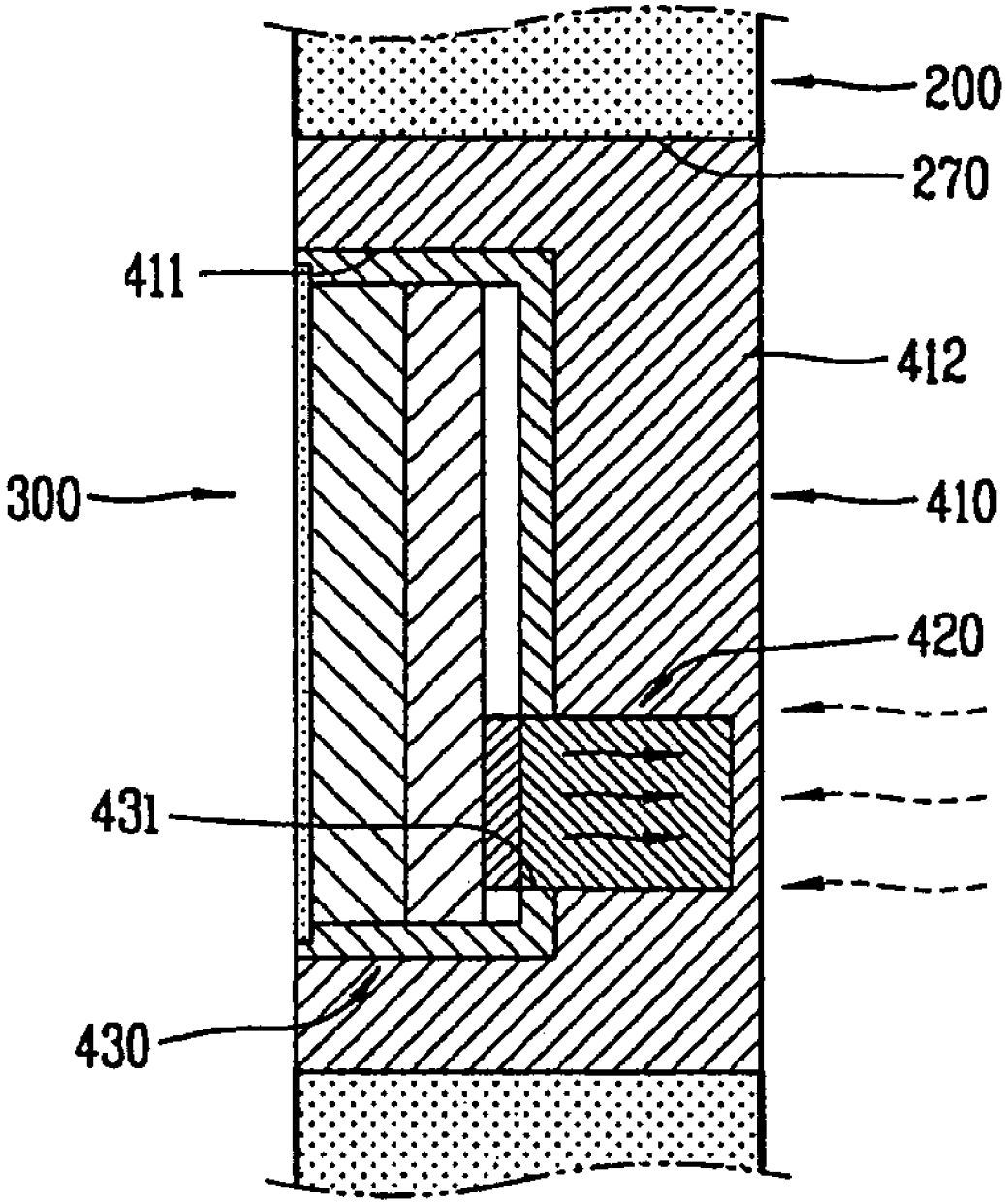
FIG. 6 is a sectional view showing an operation state of the radiation unit.

As shown in FIG. 6, heat generated from the control circuit board 320 is transferred to the heat transfer member 420. Heat transferred to the heat transfer member 420 is cooled while being transferred toward the refrigerating chamber or the freezing chamber, the inner side of the refrigerator door 200. As this process is continuously performed, heat generated from the display 300 is released while being transferred to the refrigerating chamber or to the freezing chamber.

In addition, when the heat transfer thin plate is mounted at the rear surface of the display 300, heat can be more effectively released from the display 300.

The insulation casing 410 prevents cooling air at the inner side of the refrigerator door 200 from being transferred externally, and the display casing 430 protects the display 300 when vibration or impact occurs.

The display 300 of the refrigerator can be installed at the refrigerator body 100, as well as at the refrigerator door 200.

In addition, the display 300 can be mounted at various types of refrigerators. The display 300 may include a function of displaying an image variably such as a touch screen, without being limited to the function for a TV.

As so far described, the refrigerator having a display of the present invention has the following advantages.

That is, for example, first, since the refrigerator keeping food items additionally has the various image display functions including the TV function, there is no need to install a TV in a room. Thus, space utilization of the room or the kitchen can be heightened, and in addition, an indoor decoration effect can be improved with the large refrigerator.

Second, since the refrigerator has the food item refrigerating function and the TV function, convenience in using electronic devices can be improved.

Third, since heat generated from the display 300 is effectively released, the display 300 can operate smoothly.

Forth, the refrigerator has a simple structure with fewer components, its fabrication and assembly are easy.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator having a display, comprising:

a refrigerator body having a freezing chamber and a refrigerating chamber;

a refrigerator door mounted on the refrigerator body;

a display mounted on the refrigerator body or on one side of the door; and a radiation unit for cooling heat generated from the display, wherein the radiation unit comprises:

a mounting part configured to receive therein the display and having a panel frame disposed adjacent a front surface of the refrigerator door, and an air circulation passage formed between the mounting part and a rear surface of the display and comprising an inlet and outlet formed in the panel frame.

2. The refrigerator of claim 1, wherein the display is mounted on the refrigerator door.

3. The refrigerator of claim 1, wherein the mounting part is formed with a prescribed area and depth in the front surface of the door.

4. The refrigerator of claim 3, wherein the mounting part is formed such that a recess is formed with a certain area and depth at an insulation member constituting the refrigerator door and an inner casing formed corresponding to the shape of the recess formed at the insulation member is inserted in the recess of the insulation member.

5. The refrigerator of claim 1, wherein the inlet and the outlet include a plurality of small holes.

6. The refrigerator of claim 1, wherein the inlet and the outlet are respectively formed at upper and lower portions of the panel frame.

7. The refrigerator of claim 1, wherein the inlet and the outlet are respectively formed at left and right portions of the panel frame.

8. The refrigerator of claim 3, wherein a heat releasing fan for forcibly circulating air is provided in the air circulation passage.

9. The refrigerator of claim 8, wherein the heat releasing fan is installed adjacent to an element that generated the most heat among parts constituting the display.

10. The refrigerator of claim 1, wherein the radiation unit comprises:

a mounting hole penetratingly formed with a certain area at one side of the refrigerator door;

an insulation casing insertedly fixed in the mounting hole of the refrigerator door and having a mounting recess in which the display is mounted; and a heat transfer member coupled to the insulation casing and transferring heat generated from the display to a cold space at an inner side of the door.

11. The refrigerator of claim 10, wherein the mounting hole of the refrigerator door is formed in a square form, and the insulation casing has a hexahedral outer shape and includes the mounting recess formed at one surface thereof.

12. The refrigerator of claim 10, wherein the display is inserted into the display casing having a certain shape and mounted in the mounting recess of the insulation casing.

13. The refrigerator of claim 10, wherein the heat transfer member has a certain length, is coupled to a real wall of the insulation casing, and is in contact with the heat generating element of the display.

14. The refrigerator of claim 13, wherein the heat generating element is an inverter of the display.

15. The refrigerator of claim 10, wherein the heat transfer member is penetratingly coupled to a rear wall of the insulation casing.

16. The refrigerator of claim 15, wherein a plurality of radiation fins are formed at an end portion of the heat transfer member penetrating the rear wall of the insulation casing.

17. The refrigerator of claim 10, wherein the heat transfer member is coupled to be positioned in a rear wall of the insulation casing.

18. The refrigerator of claim 10, wherein a heat transfer thin plate having a prescribed area is attached at a rear surface of the display and the heat transfer member is connected to the heat transfer thin plate.

19. The refrigerator of claim 10, wherein the heat transfer member contains aluminum.

20. The refrigerator of claim 18, wherein the heat transfer thin plate contains at least one of aluminum or copper.

21. A refrigerator having a display, comprising:

a refrigerator body having a freezing chamber and a refrigerating chamber;

a refrigerator door mounted on the refrigerator body;

a display mounted on the refrigerator body on one side of the door; and a radiation unit for cooling heat generated from the display, wherein the radiation unit comprises:

a mounting part formed with a prescribed area and depth at a front surface of the door and having the display inserted therein; and an air circulation passage for guiding external air to flow externally after passing through between an inner wall of the mounting part and a rear surface of the display, wherein the air circulation passage comprises:

an inlet and an outlet formed penetratingly at a panel frame fixing the display to the refrigerator door and covering the mounting part and an inner passage; and a space existing between a rear wall of the display and an inner wall of the mounting part, and communicating with the inlet and the outlet of the panel frame, and wherein the inlet and the outlet are respectively formed at upper and lower portions of the panel frame.

22. A refrigerator having a display, comprising:

a refrigerator body having a freezing chamber and a refrigerating chamber;

a refrigerator door mounted on the refrigerator body;

a display mounted on the refrigerator body on one side of the door; and a radiation unit for cooling heat generated from the display, wherein the radiation unit comprises:

a mounting part formed with a prescribed area and depth at a front surface of the door and having the display inserted therein; and an air circulation passage for guiding external air to flow externally after passing through between an inner wall of the mounting part and a rear surface of the display, wherein the air circulation passage comprises:

an inlet and an outlet formed penetratingly at a panel frame fixing the display to the refrigerator door and covering the mounting part and an inner passage; and a space existing between a rear wall of the display and an inner wall of the mounting part, and communicating with the inlet and the outlet of the panel frame, and wherein the inlet and the outlet are respectively formed at left and right portions of the panel frame.

23. A refrigerator having a display, comprising:

a refrigerator body having a freezing chamber and a refrigerating chamber;

a refrigerator door mounted on the refrigerator body;

a display mounted on the refrigerator body or on one side of the door; and a radiation unit for cooling heat generated from the display, comprising:

a mounting hole penetratingly formed with a certain area at one side of the refrigerator door;

an insulation casing insertedly fixed in the mounting hole of the refrigerator door and having a mounting recess in which the display is mounted; and a heat transfer member coupled to the insulation casing and transferring heat generated from the display to a cold space at an inner side of the door.

24. The refrigerator of claim 23, wherein the mounting hole of the refrigerator door is formed in a square form, and the insulation casing has a hexahedral outer shape and includes the mounting recess formed at one surface thereof.

25. The refrigerator of claim 23, wherein the display is inserted into the display casing having a certain shape and mounted in the mounting recess of the insulation casing.

26. The refrigerator of claim 23, wherein the heat transfer member has a certain length, is coupled to a real wall of the insulation casing, and is in contact with the heat generating element of the display.

27. The refrigerator of claim 26, wherein the heat generating element is an inverter of the display.

28. The refrigerator of claim 23, wherein the heat transfer member is penetratingly coupled to a rear wall of the insulation casing.

29. The refrigerator of claim 28, wherein a plurality of radiation fins are formed at an end portion of the heat transfer member penetrating the rear wall of the insulation casing.

30. The refrigerator of claim 23, wherein the heat transfer member is coupled to be positioned in a rear wall of the insulation casing.

31. The refrigerator of claim 23, wherein a heat transfer thin plate having a prescribed area is attached at the rear surface of the display and the heat transfer member is connected to the heat transfer thin plate.

32. The refrigerator of claim 31, wherein the heat transfer thin plate contains at least one of aluminum or copper.

33. The refrigerator of claim 23, wherein the heat transfer member contains aluminum.

* * * * *